US005213256A

United States Patent [19]

Cyr

[11] Patent Number: 5,213,256

[45] Date of Patent: May 25, 1993

[54] CONTAINER ASSEMBLY HAVING A REMOVABLE INSERT/DIVIDER

[75] Inventor: Stephen J. Cyr, Chippewa Falls, Wis.

[73] Assignee: Amoco Corporation, Chicago, Ill.

[21] Appl. No.: 27,345

[22] Filed: Mar. 18, 1987

[51] Int. Cl.[5] ..... B65D 85/54

[52] U.S. Cl. ..... 229/120.32; 229/904

[58] Field of Search ..... 229/2.5 R, 2.5 EC, 44 R, 229/45 R, 45 RC, 904, 905, 906, 902, 7 SC, 101, 120.02, 120.07, 120.32; 206/524.4, 219

[56] References Cited

U.S. PATENT DOCUMENTS

| | | | |
|---|---|---|---|
| 2,510,211 | 6/1950 | Cleary | 229/7 SC |
| 2,852,177 | 9/1958 | Frasch | 229/902 |
| 4,226,358 | 10/1980 | Ottow | 229/44 R |
| 4,241,863 | 12/1980 | Fauer | 229/2.5 R |

*Primary Examiner*—Willis Little

*Attorney, Agent, or Firm*—Matthew R. Hooper; Stephen L. Hensley; Frank J. Sroka

[57] ABSTRACT

A container assembly comprising a container having a first section having a bottom wall, sidewalls, and end walls and a second section adapted to lie over the open top of said first section to selectively close the open top of said first section and an insert means adapted to separate the contents of said sections, said insert being removable from said container while said container is in a closed position. The container assembly of the present invention is particularly useful in maintaining the hot/-cold or moist/dry components of a food product separate until just prior to consumption at which time the insert is removed and the components of the food product are combined. The insert is removable while the container is closed so that the components of the food product can be combined without necessitating handling by the consumer.

8 Claims, 3 Drawing Sheets

CONTAINER ASSEMBLY HAVING A REMOVABLE INSERT/DIVIDER

BACKGROUND OF THE INVENTION

This invention relates to a container assembly, more particularly to a container assembly comprising a container having two sections and an insert between said members which separates the contents of said sections.

In certain situations, it is desirable to keep certain components of the contents of a container separate for combination within said container at a future time. An example of such a situation is the desire to keep a hot portion of a food separated from a cooler portion of the food until just prior to consumption. In the fast-food business, the food is often stored for a short period of time during which it is desirable to separate the hot and cooler portions of the food until just prior to consumption by the purchaser. The same considerations applied when one portion of the food are moist and other portion is dry. Prolonged contact of the hot/cooler or moist/drier portions of the food over a period of time can result in a food product which is not particularly appetizing to the purchaser. A known method of maintaining the components of a food product separate is the use of a two compartment sandwich package wherein the hot and cold sandwich components are placed in the compartments which are side by side and the package is covered with a top. After purchase of the product, the purchaser then manually places one component of the sandwich over the component of the sandwich and consumes it. Such packages are typically double the length of the typical one compartment containers which hold the sandwich in its assembled configuration. A dual purpose container is disclosed in U.S. Pat. No. 2,510,211 which requires special adaptation of the walls of the container to receive a removable partition. Further, around the sides said partition, the reference requires an addition part, a so-called "flexible element" which is removed prior to the removal of the partition. U.S. Pat. No. 2,558,124 discloses a container having a partition attached to a hinge which connects the two portions of said container. The partition has an opening therein to accommodate a component of the contents of said container. The partition is intended to maintain the components of the top and bottom of the container separate at all times. The partition is attached to the hinge and therefore cannot be removed when the container is in a closed position.

It would be desirable to have a container which is a convenient size for storage and handling by the producer and users, has means to conveniently combine the contents of the container with minimal disruption of the container or components therein and permits such combination without the handling of the contents prior to consumption. It would be a further advantage to avoid the need to make any special adaptations the walls of the container in order to achieve the separation of the contents. It would also be desirable to have a container assembly which uses existing containers to avoid the expense of replacing such containers.

It is an object of this invention to provide a container assembly having a convenient means of separating certain components therein wherein said means is removable while said container is in a closed position. Another object of this invention is a method of combining certain components of the contents of a closed container without opening said container or handling said contents prior to opening.

SUMMARY OF THE INVENTION

A container assembly comprising a container having two sections and an insert placed between said sections, said insert being removable from said container while it is in a closed position is disclosed wherein said insert separates the components of the two sections until removal of said insert.

According to the present invention, there is provided a container assembly comprising in combination, a container having (a) a first space-defining section having a bottom wall, sidewalls and end walls and an open portion opposite said bottom wall and (b) a second space-defining section having a bottom wall, sidewalls and end walls and an open portion opposite said bottom wall, said second section being adapted to lie over the open portion of said first section to close at least one of said open portions; and an insert laying between said open portions of said sections, said insert having a tab element on at least one end thereof which extends beyond at least one of the end walls or sidewalls of said container wherein said insert is removable from said container while said container is in a closed position.

DETAILED DESCRIPTION OF THE INVENTION

The present invention is described in detail as a container assembly for a food product. The embodiments shown and described are only illustrative of the present invention and are not to be construed as being delimitive thereof, since once apprised of the invention, changes in structure and contents would be readily apparent to one skilled in the art. Such changes include the shape of the container and the corresponding shape of the insert as well as the specific contents of each section. The container of the present invention can be used to maintain other types of components separate for a future combination. The shape of the container and the insert will depend upon the functional and decorative requirements for the desired end use as well as the extent of separation of the contents desired. The container assembly of this invention can comprise a stack of several containers wherein the top and bottom walls of the inside containers are formed by the inserts. In describing the embodiments herein, the sections and walls are sometimes referred to as top and bottom but such positions can be reversed or could be described as side members; a particular orientation described herein is used for convenience of description and not as a means of limiting the invention.

Figures 1, 2:
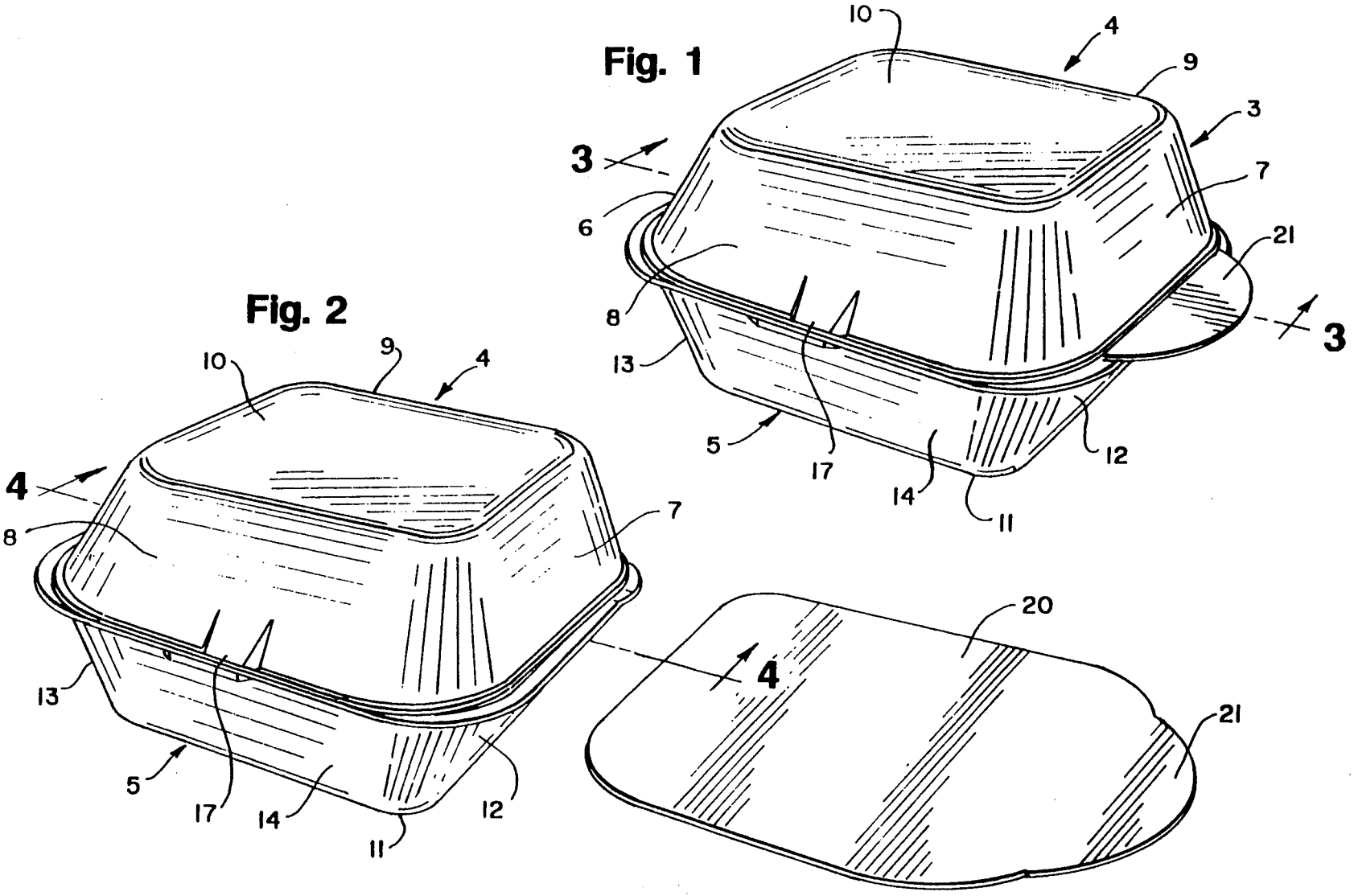
FIG. 1 shows a perspective view of an embodiment of the container assembly of this invention in a closed position.
FIG. 2 shows a perspective view of an embodiment of the container assembly of this invention after the insert has been removed from the container.

FIG. 1 shows the container assembly generally designated by the numeral 3 in a closed position, said assembly comprising a container having a first section 4 comprising side walls 6 ad 7, end walls 8 and 9, and a wall 10 connecting said end and side walls. The second section 5 comprises side walls 12 and 13, end wall 14, ad a wall 11 connecting said side and end walls. The container is also provided with a locking means 17 for holding the sections together in the closed position of the container. In a preferred embodiment of the invention, the two sections are formed from plastic material which are theremoformed integrally and are joined together along one end wall by a thermoformed hinge. Such containers are well known and examples thereof are illustrated in U.S. Pat. No. 3,942,707, U.S. Pat. No. 3,977,595 and U.S. Pat. No. 4,079,880, all incorporated herein be reference. The insert is between the two sections of the container and the tab element 21 of said insert extends beyond at least one of the sidewalls of said container.

Figure 3:
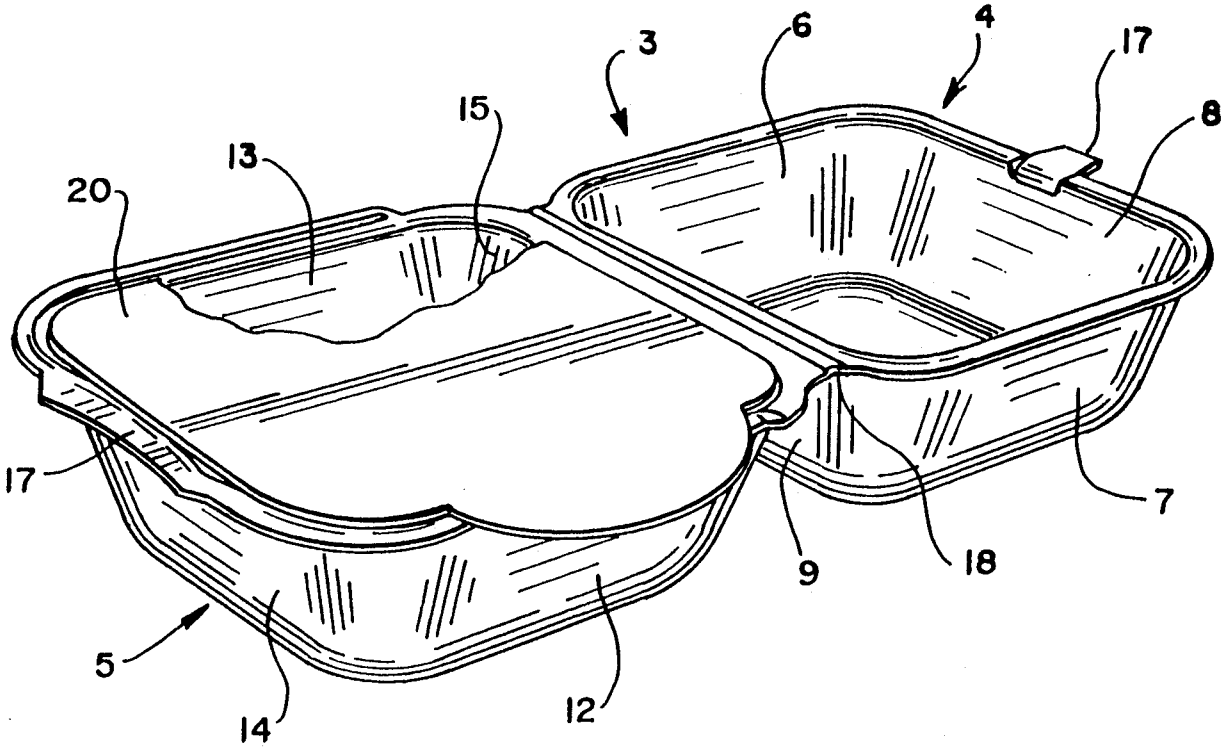
FIG. 3 shows a perspective view of an embodiment of the container assembly of this invention in an open position.

The locking means for holding the sections of the container together in a closed position is shown in FIGS. 1, 2, and 3 as a locking flap and a corresponding slot in the end walls of said sections opposite the end wall having the hinge. However, any convenient locking means such as that described in U.S. Pat. No. 4,079,880 herein incorporated by reference, can be used in container of the assembly of this invention. Said locking means includes: (a) a shoulder standing outwardly from a sidewall of said first section, the shoulder standing extending along the side wall towards the end wall and being integral for at least part of the distance along the sidewall to stiffen the shoulder upon the sidewall; (b) a locking projection extending from the shoulder and along the sidewall towards the end wall and terminating in a peak, the projection being spaced from the sidewall to form a recess which is open towards the end wall; and (c) a locking flap formed from the other section, the flap having a border defining an aperture and being pivotally mounted about a pivotal axis on the other section. With the sections close together, the projection extends from the shoulder away from said first section and the flap is pivotal into a container locking position by passing around the projection and the shoulder so as to dispose the peak and part of the shoulder through the aperture from one side to the other of the flap, the peak being allowed to pass through the aperture at resilient flexure of one of the components; and the flap in its locking position having its border located in a recess with the flap and its border extending from the pivotal axis towards the end wall of said first section while passing around the shoulder and into the recess and with the border thereby extending outwardly of the recess towards said end wall to locate the flap and border extending in the general direction of opening movement of the sections to transmit any force tending to open the sections from the recess to the border in a direction radially outward from the pivotal axis of the flap and in the plane of the border.

FIG. 2 shows the container assembly after the insert 20 removed. As shown in FIG. 1, the insert is a relatively thin planar sheet which permits substantial closure and locking of said container. The insert has at least one tab aperture 21 which, when the insert is between the two sections of the container, extends beyond at least one sidewall of said container so that it can be readily grasped and used to remove the entire insert from said container. The tab aperture 21 can be embossed with instructions such as "PULL" to guide the purchaser in removing the insert to combine the sandwich components for consumption.

FIG. 3 shows the container assembly generally designated by the numeral 3 in an open position, said assembly comprising a container having a first section 4 comprising sidewalls 6 and 7, end walls 8 and 9. The second section 5 comprises sidewalls 12 and 13 and end wall 14 and 15. and a wall 11 connecting said side and end walls. Said first and second section are connected to each other at the edges of the end walls opposite the locking means 17 by means of a hinge 18.

Figure 4:
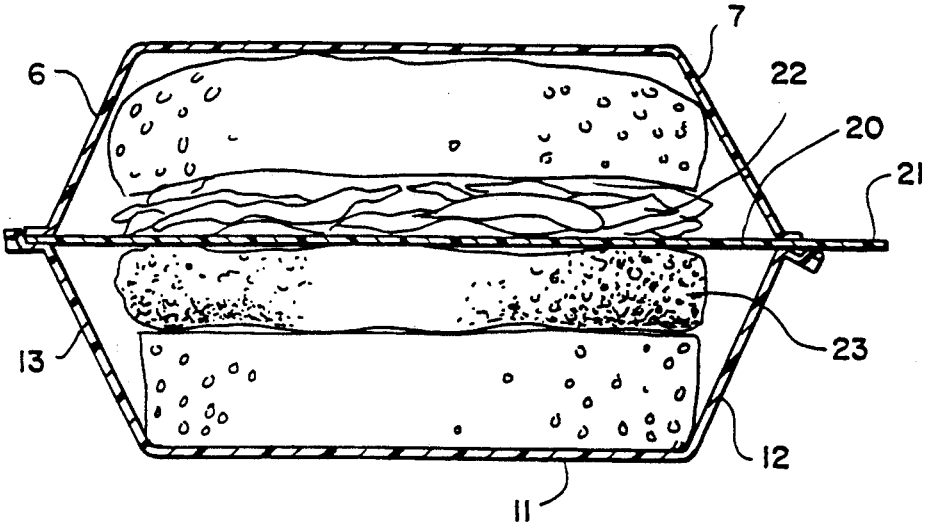
FIG. 4 is a cross sectional view along line 3—3 in FIG. 1 showing the contents of each section of the container being separated by the insert.

FIG. 4 shows the container assembly of this invention containing a hamburger sandwich. The upper portion of the sandwich 22 is in the first section of the container and is separated by the insert 20 from the other portion of the sandwich 23 which is contained in the second section of said container. As illustrated in FIG. 4, the cooler portion of the sandwich are thereby kept separate from the hotter portion of the sandwich while the sandwich is being stored or transported to another location for consumption.

Figure 5:
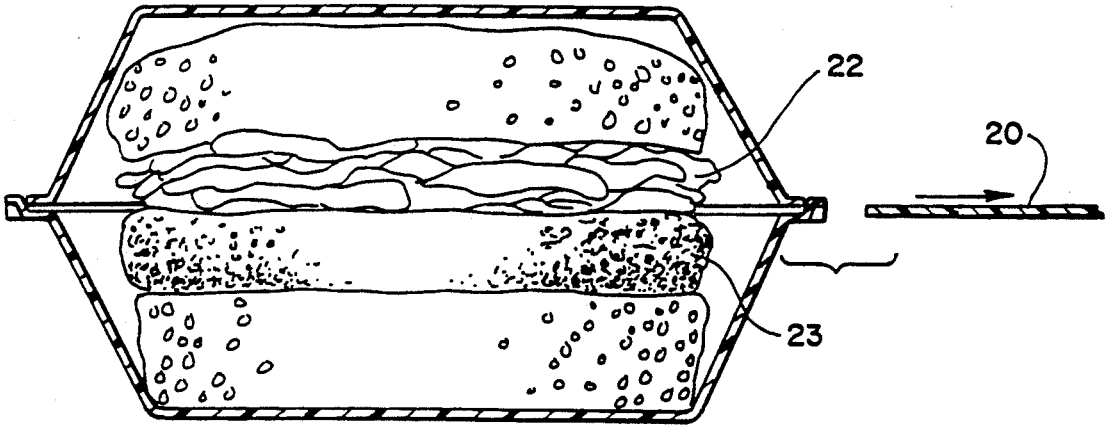
FIG. 5 shows a cross sectional view along line 4—4 of FIG. 2 wherein the contents of each section have combined after removal of the insert.

FIG. 5 shows the contents of the container assembly of this invention after the insert is removed. The upper and lower portions of the sandwich have been conveniently combined without the necessity of handling by the purchaser. The insert is constructed of material which will readily slide out of said container with minimally disruption of the contents of each section so that the resulting sandwich is attractive and appetizing in appearance.

The container and insert of the present invention can be made by any convenient process depending upon the material used to make said container and insert. In a preferred embodiment of the invention, a food package is made by a thermoforming process from a plastic material. The plastic material may be a foamed or non-foamed plastic material, preferably a foamed thermoplastic material such as polystyrene, polycopolymers, polyethylene, polypropylene and polyvinylchloride. As stated previously, the two sections of the container can be thermoformed integrally and joined together along one end wall by a thermoformed hinge so that either section is swingable from an opened position to a closed position overlying the open top of the other section. It has been found that when using a foamed polystyrene sheet material as the insert, it is beneficial to coat the sides of said sheet material with a polymeric resinous material in order to reduce the friction between said insert and the contents and edges of the container thereby facilitating removal of the insert. The coating can be applied to the sheet material by means of the process disclosed in U.S. Pat. No. 3,616,020 herein incorporated by reference. Examples of the polymeric resinous materials which can be used to coat said sheet material include acrylonitrile-butadiene-styrene, acrylonitrile-styrene, polyvinylchloride, crystalline polystyrene, polyethylene, polypropylene or rubber modified polystyrene. The polyethylene and polypropylene coatings are limited to polyethylene and polypropylene substrates respectively. The preferred foam material is polystyrene and the preferred resinous material is rubber modified polystyrene.

The foam materials are particularly preferred because they can be mass produced very economically, are light weight and can be reliability stacked in a neat and orderly arrangement both prior and after filling with food. The flat planar inserts can also be stacked in a convenient manner and, in most instances, can be applied to the existing supply of containers depending upon their relative shape and the extent of separation desired.

Although the present invention has been described with a certain degree of particularity, it is understood that the present disclosure has been made by way of example and that changes in details of the structure may be made without departing from the spirit thereof.

What is claimed is:

1. A container assembly comprising in combination, a container comprising a plastic material and having (a) a first space-defining section having a bottom wall, sidewalls and end walls and an open portion opposite said bottom wall, (b) a second space-defining section having a bottom wall, sidewalls and end walls and an open portion opposite said bottom wall, said second section being adapted to lie over the open portion of said first section to close at least one of said open portions, wherein said sections are joined together by a hinge at the edges of corresponding walls of said sections, (c) locking means for holding said sections together disposed upon the walls of said sections directly opposite the hinge, and (d) a planar insert positioned between said open portions of said sections, said insert comprising foam polystyrene coated with a polymeric resinous material and having a tab element on at least one end thereof which extends beyond at least one of the end walls or sidewalls of said container whereby said insert is removable from said container while said container is in a closed position.

2. A container assembly of claim 1 wherein said first and second sections each define hollow cavities bounded by said walls.

3. A container assembly of claim 1 wherein two separate hollow cavities separated by said insert are formed when said container is in the closed position.

4. The assembly of claim 1 wherein the locking means is disposed upon the end walls of said sections.

5. A plastic food package comprising in combination:

a container having (a) a first space-defining section having a bottom wall, sidewalls and end walls and an open portion opposite said bottom wall and (b) a second space-defining section having a bottom wall, sidewalls and end walls and an open portion opposite said bottom wall, said second section being adapted to lie over the open portion of said first section to close at least one of said open portions, wherein said sections are joined together by a hinge at the edges of corresponding walls of said sections, and a planar insert positioned between the open portions of said sections, said insert having a tab element on at least one end thereof which extends beyond at least one of the end walls or sidewalls of said sections wherein said insert is removable from said container while said container is in a closed position, wherein said container and said insert are thermoformed from foamed polystyrene and said insert is coated on both sides with a polymeric resinous material.

6. The package of claim 5 wherein said resinous material is rubber modified polystyrene.

7. A plastic food package comprising in combination:

a container having (a) a first space-defining section having a bottom wall, sidewalls and end walls and an open portion opposite said bottom wall and (b) a second space-defining section having a bottom wall, sidewalls and end walls and an open portion opposite said bottom wall, said second section being adapted to lie over the open portion of said first section to close at least one of said open portions, wherein said sections are joined together by a hinge at the edges of corresponding walls of said sections, and a planar insert positioned between the open portions of said sections, said insert having a tab element on at least one end thereof which extends beyond at least one of the end walls or sidewalls of said sections wherein said insert is removable from said container while said container is in a closed position, and a food product comprising a first component and a second component wherein said first component is in said first section on one side of said insert and said second component is in said section on the opposite side of said insert, wherein said container and said insert are thermoformed from a sheet of foamed polystyrene and wherein said insert is coated with a polymeric resinous material.

8. A method of combining the components of a closed container comprising:

placing a food product comprising a first component and a second component into a container assembly comprising in combination, a container having (a) a first space-defining section having a bottom wall, sidewalls and end walls and an open portion opposite said bottom wall and (b) a second space-defining section having a bottom wall, sidewalls and end walls and an open portion opposite said bottom wall, said second section being adapted to lie over the open portion of said first section to close at least one of said open portions; and an insert positioned between said open portions of said sections, said insert having a tab element on at least one end thereof which extends beyond at least one of the end walls or sidewalls of said container wherein said insert is removable from said container while said container is in a closed position, wherein said first component is placed in said first section and said insert is placed over said first component and first section, and said second component is placed in said second section, and said sections are joined together to form a closed container; and said insert is removed from said closed container by means of a tab element on at least one end thereof which extends beyond the sidewalls of said container.

wherein said container and said insert are formed from a sheet of foamed polystyrene.

* * * * *